US007644882B2

(12) United States Patent
Potts

(10) Patent No.: US 7,644,882 B2
(45) Date of Patent: Jan. 12, 2010

(54) ROTATING MINERAL BREAKER

(75) Inventor: Alan Potts, Somercotes (GB)

(73) Assignee: MMD Design & Consultancy Limited (GB)

( * ) Notice: Subject to any disclaimer, the term of this patent is extended or adjusted under 35 U.S.C. 154(b) by 78 days.

(21) Appl. No.: 11/495,240

(22) Filed: Jul. 28, 2006

(65) Prior Publication Data

US 2007/0029421 A1 Feb. 8, 2007

(30) Foreign Application Priority Data

Jan. 30, 2004 (GB) ..... 0401993.1
Mar. 26, 2004 (GB) ..... 0406802.9

(51) Int. Cl.
*B02C 13/20* (2006.01)

(52) U.S. Cl. ..... 241/46.06; 241/186.4; 241/186.5; 241/187

(58) Field of Classification Search ..... 241/260.1, 241/235, 236, 222, 224, 225, 46.06, 46.08, 241/186.4, 186.5, 187
See application file for complete search history.

(56) References Cited

U.S. PATENT DOCUMENTS

| | | | | |
|---|---|---|---|---|
| 3,643,591 A | | 2/1972 | Bragg | 100/95 |
| 4,799,627 A | * | 1/1989 | Potts | 241/236 |
| 5,351,899 A | * | 10/1994 | Koenig | 241/260.1 |
| 5,975,441 A | | 11/1999 | Burkholder | 241/24.12 |
| 6,296,124 B1 | | 10/2001 | Zubragel | 209/672 |

FOREIGN PATENT DOCUMENTS

| | | | |
|---|---|---|---|
| DE | 20208107 | | 10/2002 |
| EP | 0114725 | | 8/1984 |
| EP | 0167178 | | 1/1986 |
| EP | 0635313 | | 1/1995 |
| GB | 2056879 | | 3/1981 |
| GB | 2088746 | | 6/1982 |
| GB | 2094662 | | 9/1982 |
| GB | 2186503 | | 8/1987 |
| JP | 04061923 | | 2/1992 |
| JP | 2000-308853 | | 11/2000 |
| WO | WO 83/03444 | | 10/1983 |
| WO | WO 88/01201 | * | 2/1988 |
| WO | WO 95/11093 | | 4/1995 |
| WO | WO 00/35585 | | 6/2000 |

* cited by examiner

*Primary Examiner*—Mark Rosenbaum
(74) *Attorney, Agent, or Firm*—C. G. Mersereau; Nikolai & Mersereau, P.A.

(57) ABSTRACT

A breaker having a first end and a second opposed end and a plurality of breaker drums arranged side by side in a row extending between said ends, the drums being arranged with their axes of rotation parallel to one another, at least two neighboring drums adjacent to the first end being arranged to continuously rotate in the same direction to define feeder drums for feeding material toward the second end, each breaker drum having radially projecting breaker teeth which co-operate with opposed breaker teeth on the adjacent drum to grip oversized material therebetween to cause breakage thereof, to permit passage of undersized material therebetween and to move unbroken oversized material toward said second end.

18 Claims, 8 Drawing Sheets

ROTATING MINERAL BREAKER

The present invention relates to a mineral breaker, in particular (but not exclusively) a mineral breaker which is versatile in use and which is capable of breaking down mineral in a dry condition or in a wet condition for producing a slurry.

In this specification, the term mineral is used to cover rock such as granite, limestone, etc but also is intended to cover any type of material which is mined from the ground such as clays and tar sand.

Mineral breakers of the type having a pair of contra rotating drums are known which have relatively large teeth co-operating on the opposed drums to break the mineral lumps down. A mineral breaker of this type is described in our European Patent 0167178.

The throughput (i.e. tonnage per hour) of this type of breaker is dependent upon the size of the drums (i.e. both diameter and length) and the spacing between the drums. The longer the drums, the more throughput; the greater the diameter (i.e. the greater the size of the teeth) the greater the throughput and the greater the spacing between the drums, the greater the throughput.

However increasing the size of teeth and/or the spacing between the drums causes an increase in the size of lump emerging from the breaker.

Accordingly in mining operations, such as open cast mining, where large throughputs are required (such as 10,000 tons per hour) it is a common practice to have a series of breakers through which the won mineral is passed before it is of sufficiently small lump size to be conveyed away from the mine. In this respect it is common to first deposit the infill taken directly from the mine into a primary breaker which permits undersize material to pass through and which functions to break down large lumps of mineral contained in the infill to a smaller lump size. The output from the primary breaker is then fed to a secondary breaker in order to break down lumps to an even smaller size.

Primary breakers are larger in size than a secondary breaker and the throughput capacity of a primary breaker is usually much larger than that of a secondary breaker. It is common therefore in mining installations for a primary breaker to be arranged to feed two or more secondary breakers in order to provide a continuous throughput.

It is therefore desirable to provide a breaker which is capable of handling large throughputs, such as for example 10,000 tons per hour, of infill material containing relatively large lumps (say 1 meter) and at the same time being able to reduce in one pass the size of the relatively large lumps contained in the infill to a relatively small size (say 150 mm) such that the material being output may be deposited directly onto a conveyor for the material to be conveyed out of the mine.

According to an aspect of the present invention there is provided a breaker having a first end and a second opposed end and a plurality of breaker drums arranged side by side in a row extending between said ends, the drums being arranged with their axes of rotation parallel to one another, at least two neighbouring drums adjacent to the first end being arranged to rotate in the same direction to define feeder drums for feeding material toward the second end, each breaker drum having radially projecting breaker teeth which co-operate with opposed breaker teeth on the adjacent drum to grip oversized material therebetween to cause breakage thereof, to permit passage of undersized material therebetween and to move unbroken oversized material toward said second end.

According to another aspect of the present invention there is provided apparatus for preparing a slurry from solid material and a fluid, the apparatus including a mineral breaker as defined above.

Various aspects of the present invention are hereinafter described with reference to the accompanying drawings, in which.

Figure 1:
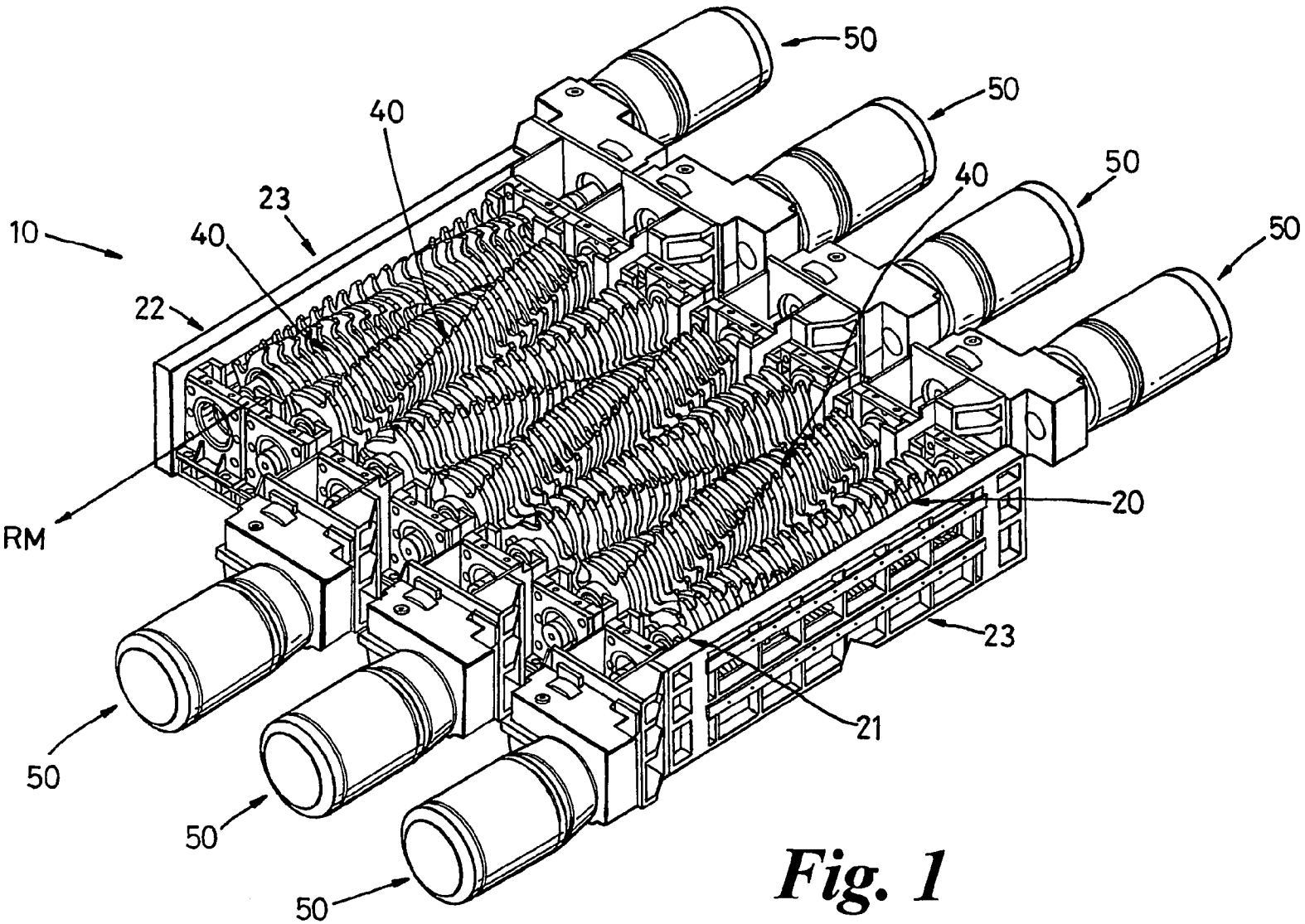
FIG. 1 is a perspective view of a breaker according to an embodiment of the present invention.

The breaker 10 illustrated in FIG. 1 includes seven breaker drum assemblies 20. The breaker 10 has a first end 21 and a second end 22, each of which is preferably defined by a side wall 23.

Figure 4:
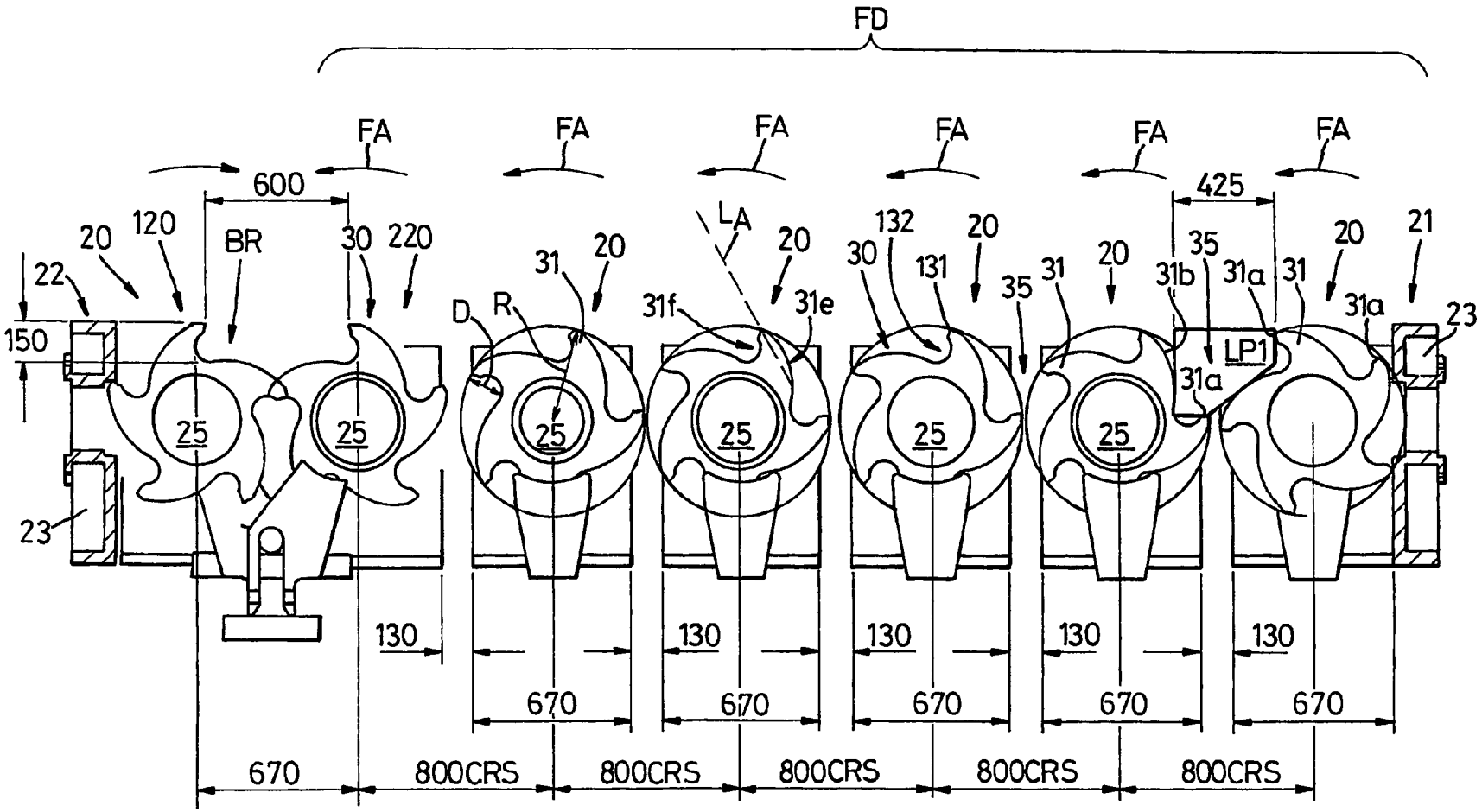
FIG. 4 is a cross-sectional view taken along line IV-IV in FIG. 2.
Figure 5:
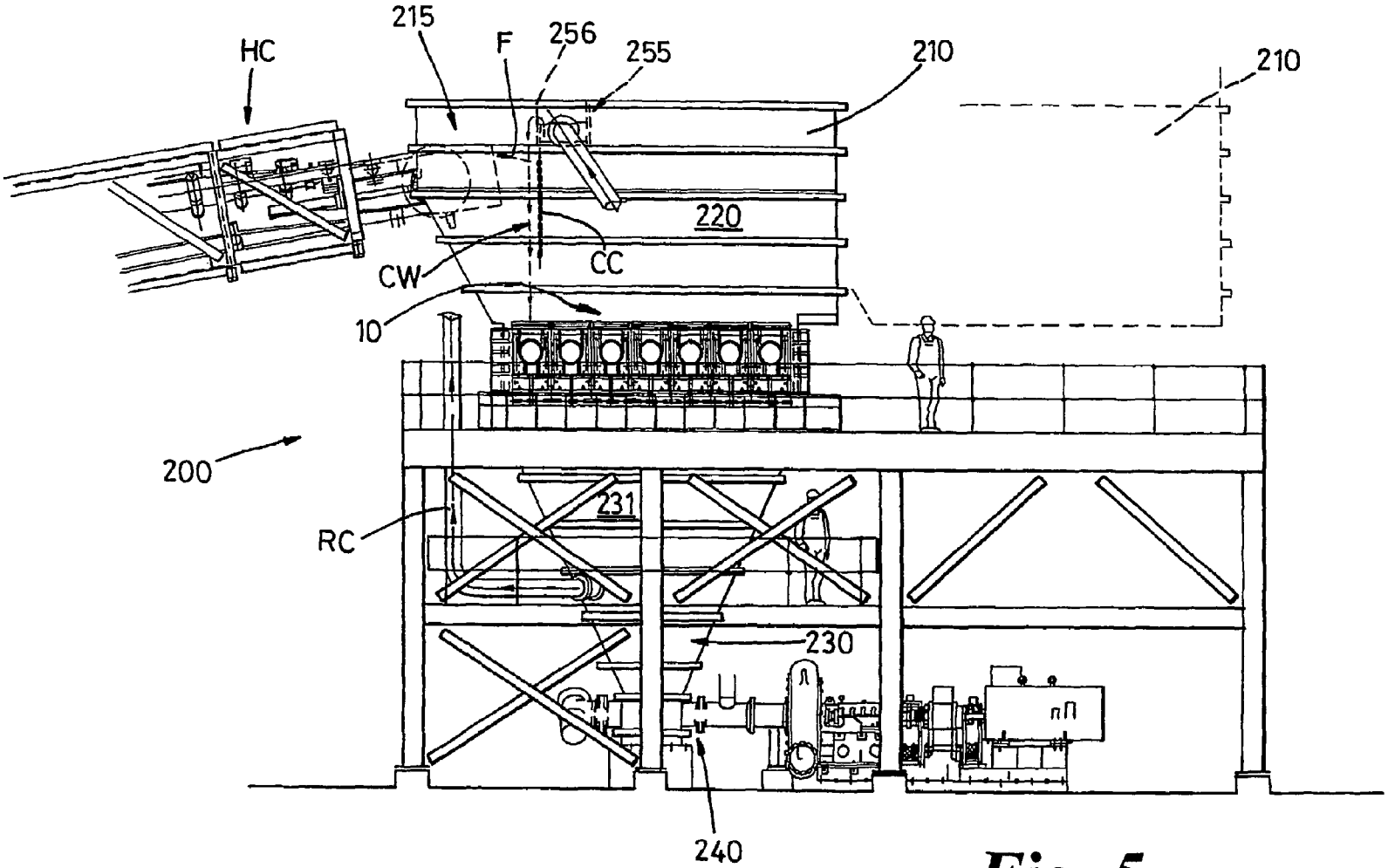
FIG. 5 is a side view of apparatus for producing a slurry according to an embodiment of the invention.
Figure 6:
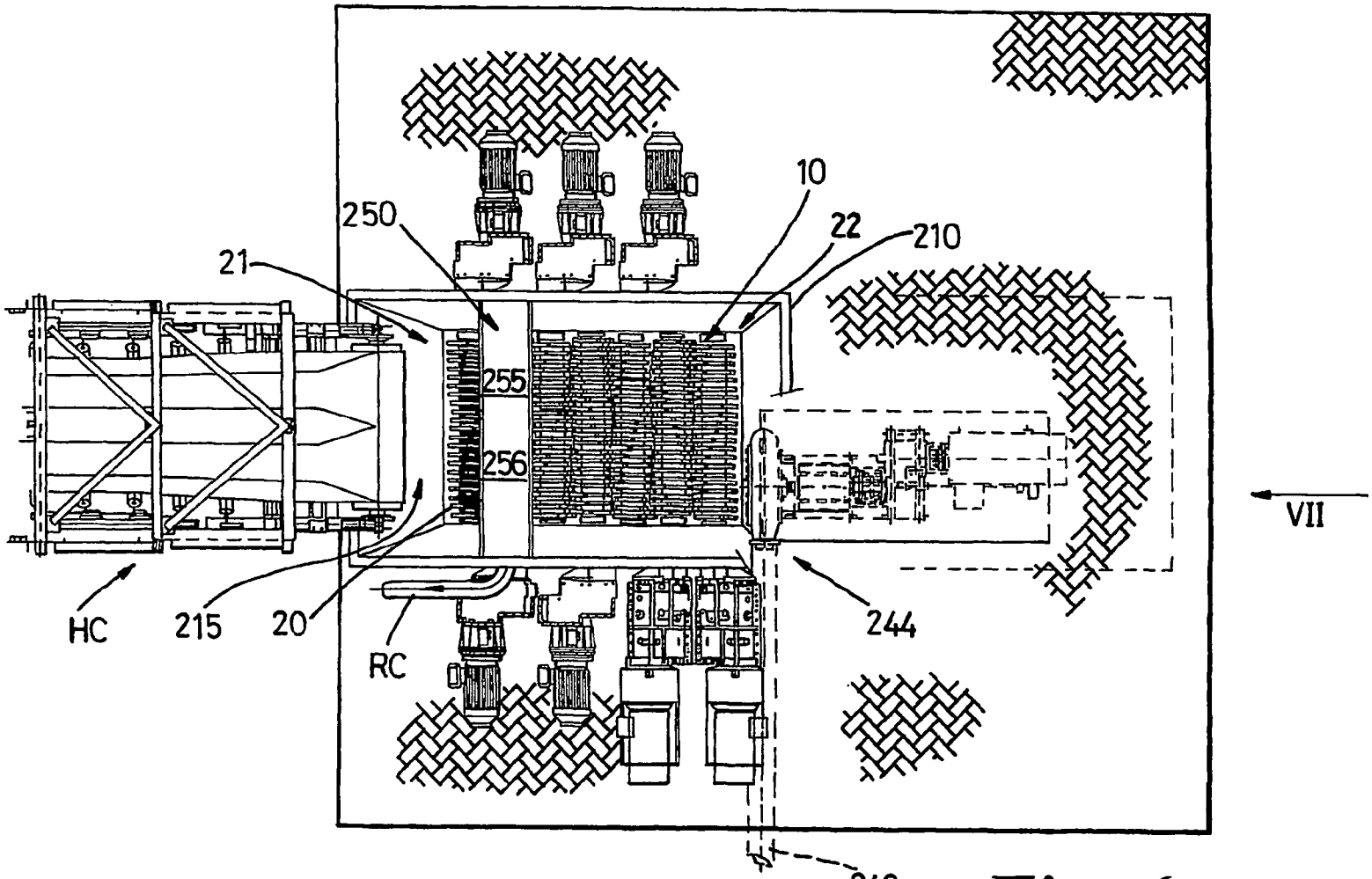
FIG. 6 is a plan view of the apparatus shown in FIG. 5.
Figure 7:
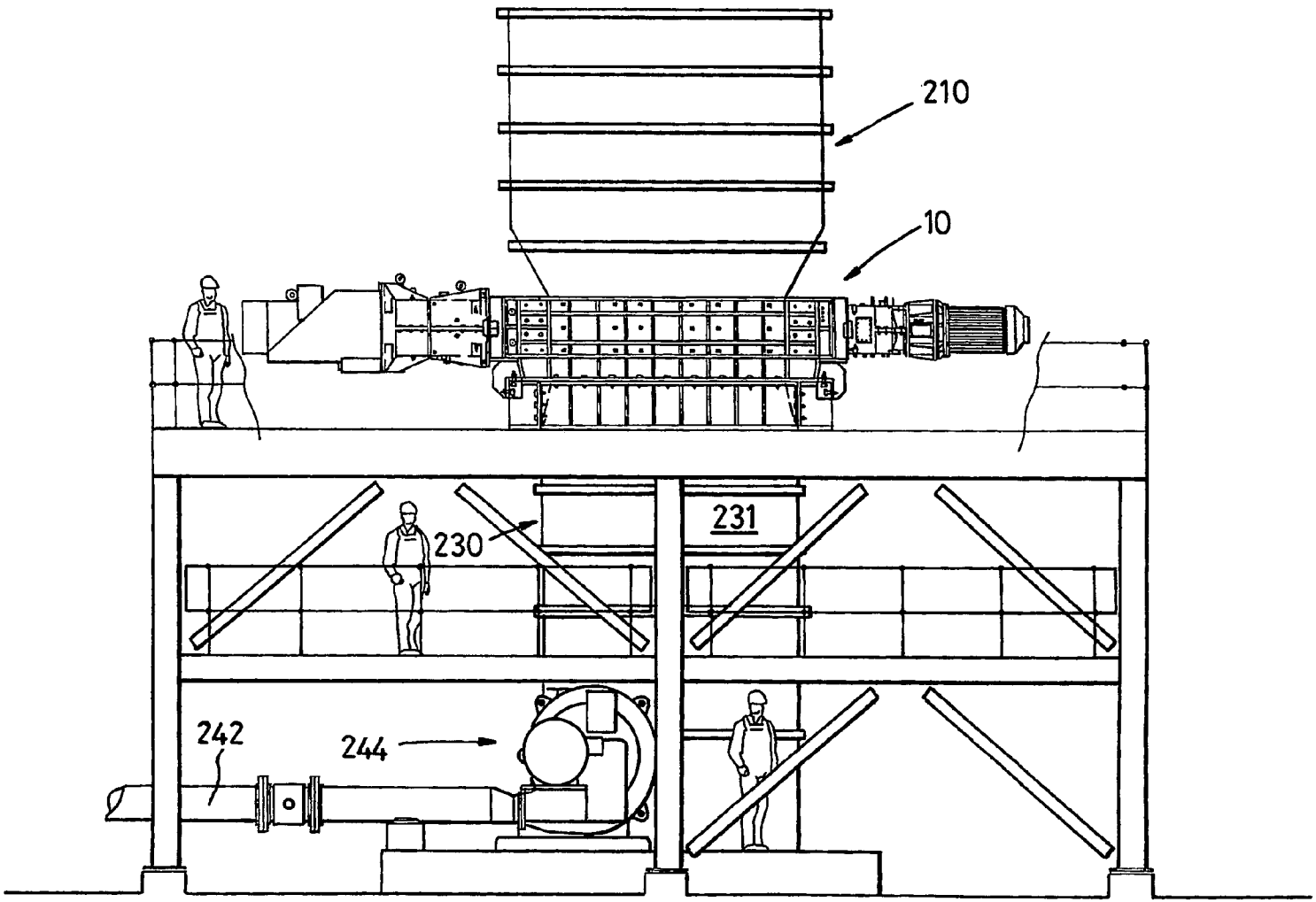
FIG. 7 is an end view of the apparatus shown in FIG. 6 as viewed in direction of arrow VII.

The breaker drum assemblies 20 are arranged side by side in a row extending between ends 21, 22. Preferably, as shown in FIG. 4, the axes of rotation of all the drum assemblies are located in the same plane.

Each drum assembly 20 includes a shaft 25 on which is mounted a plurality of toothed rings 30 spaced along the shaft.

The toothed rings 30 each contain a plurality of breaker teeth 31 spaced equally around the circumference of the ring 30. As shown in FIG. 4, the number of teeth 31 on each ring 30 is five; however it is envisaged that the number of teeth on each ring may be more or less than five. Preferably the number of teeth 31 on each ring 30 is selected from the range of three to eight teeth.

The radial height of each tooth 31 and the circumferential spacing between each tooth 31 on a ring 30 is preferably chosen such that relatively deep mineral accommodating pockets 35 are formed between opposing teeth 31 on neighbouring drum assemblies 20. Preferably the rings 30 on each shaft 25 are arranged such the teeth 31 follow a discrete helical path along the shaft and so define with the teeth 31 on neighbouring rings 30 on the same shaft relatively deep discrete material accommodating helical channels 40 extending along each shaft 25. Preferably the ratio of the depth D of a channel (as measured along a radial line from the tip of a tooth 31 to the bottom of the channel) relative to the radial height R of the tip of the tooth 31 (as measured from the axis of rotation) is in the range of 1:2 to 1:3, more preferably about 1:2.5.

The closeness of adjacent rings 30 and size and shape of teeth 30 are preferably chosen to be such that the helical channels 40 act on material deposited therein to cause it to move axially along the drum.

Preferably the helical path followed by each row of teeth passes through an angle of approximately 90° as it extends from one end of the drum assembly to the other. The angle through which the helical path travels from one end of the drum assembly to the other may be less or greater than 90° but is preferably less than 360°.

Preferably as seen in FIG. 1, each drum assembly is arranged such that the helical channels on one drum assembly extend along its shaft 25 in the opposite handed sense to the helical channels on the neighbouring drum assembly 20.

Figure 2:
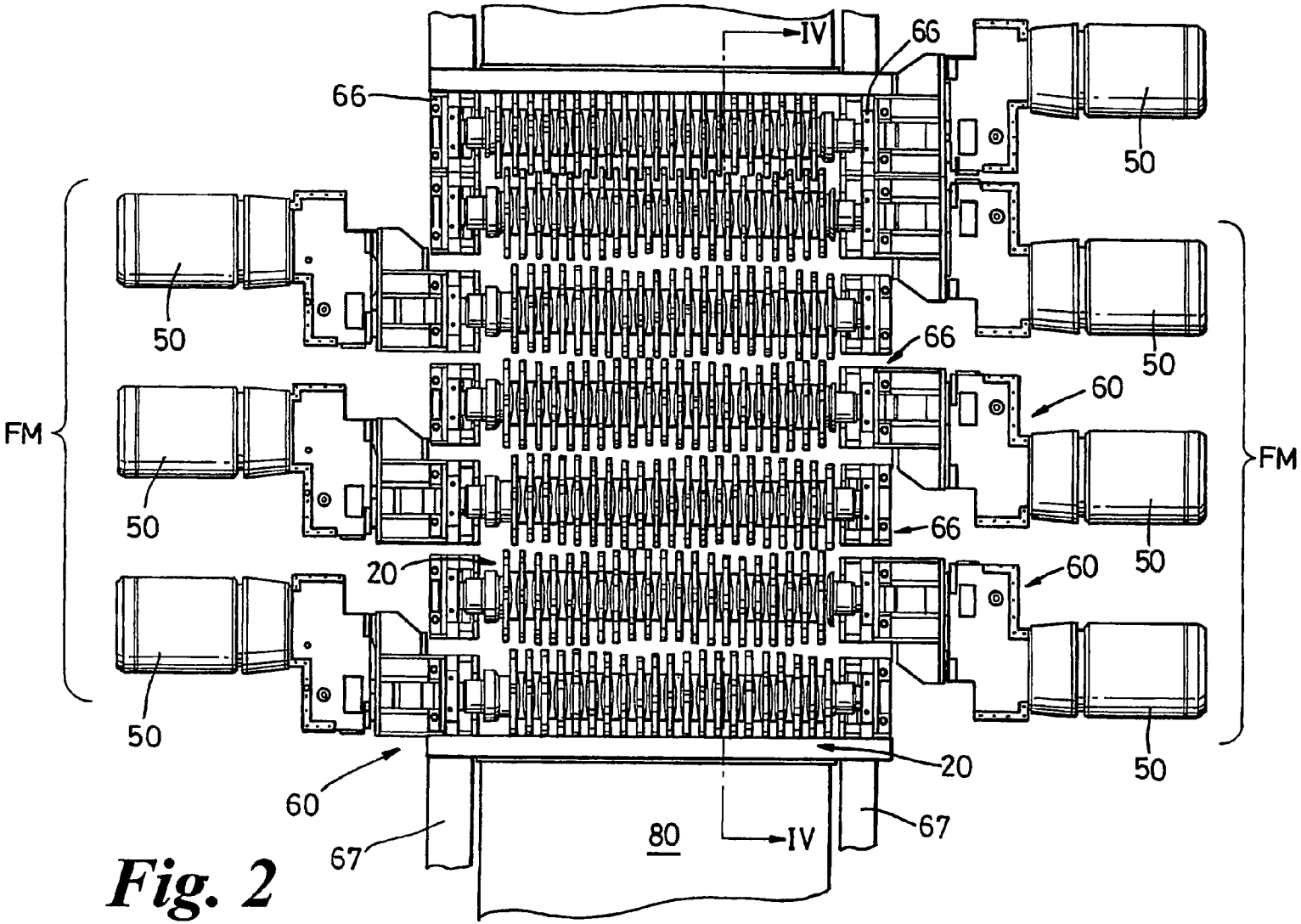
FIG. 2 is a plan view of the breaker shown in FIG. 1.

Preferably, as also seen in FIG. 2, the rings 30 on one drum assembly are axially staggered with the rings 30 on the adjacent drum assembly 20, i.e. a ring 30 on one drum assembly is located axially in-between a pair of adjacent rings 30 on the neighbouring drum assembly 20. This enables the teeth 31 on neighbouring drum assemblies to co-operate to break mineral lumps with a snapping action as discussed in our EP 0167178.

Each drum assembly 20 is preferably driven by an independent motor 50, which may be for example an electric or fluid motor. The group of motors 50 indicated as FM are each arranged to continuously rotate their associated drum assembly 20 in the same rotary direction such that the upper portion of the drum assembly rotates toward the second end 22. This is indicated by arrow FA in FIG. 4.

As illustrated in FIG. 4, the fact that adjacent drum assemblies 20 in the group FD (corresponding to those driven by the group of motors FM) are rotating in the same direction FA, the right-hand drum assembly 20 of a given pair grips material on top of the drum assembly by accommodating it in its helical channels 40 and move it toward the second end 22.

The motor 50 associated with the drum assembly 20 adjacent to the second end 22 is preferably arranged to continuously drive its drum assembly in the opposite rotary direction. Accordingly, the last two drum assemblies 120, 220 adjacent to the second end 22 define a twin drum breaker similar to that disclosed in our EP 0167178 in which the teeth on both drum assemblies 20 act to cause breakage of mineral in-between the drum assemblies and also urge the mineral being broken down in-between the drum assemblies 20. With this arrangement, oversized mineral lumps reaching the second end are positively broken down to pass through the breaker.

It is envisaged however that the last breaker drum assembly 20 adjacent to the second end 22 may also rotate in the same direction as the feeder drum assemblies. In such an arrangement, an oversized discharge opening (not shown) would be provided at the second end 22 to thereby enable the oversized lumps of material to be discharged from the breaker.

With this type of arrangement the breaker is not only acting as a breaker to break down mineral as it is moved toward the second end 22, it is also acting as a sieve or screen to remove from the infill material lumps of material over a predetermined size.

In use, infill material is deposited at end 21 onto the drum assemblies 20 at that end.

Since the upper part of the drum assemblies 20 in the group FD are rotating in the direction of the second end, material is caused to flow in that general direction by the action of the teeth 31. In view of the presence of the helical channels 40 on the drum assemblies, the material is also caused to move axially along the drum assembly in the direction dictated by the right or left handed sense of the helical channel on that drum assembly.

However as the material passes onto the next drum assembly 20, it is caused to move in the opposite axial direction along that drum assembly 20 ( due to the fact that that drum assembly is rotating in the same direction but has helical channels of opposite handed sense to those on the preceding drum assembly).

It will be appreciated therefore that as material makes it way towards the second end, it is alternately caused to flow widthwise of the breaker as it passes from one drum assembly to the next.

The spacing between adjacent drum assemblies is selected to allow mineral lumps, fines and dirt of a predetermined undersize to pass therethrough. Accordingly by causing the material to flow alternatively widthwise of the breaker as it makes it passage towards the second end 22, the material is widely distributed across the width and length of the breaker as well as being agitated during such distribution in order to encourage efficient scalping of the undersize material from the oversized lumps in the infill.

Oversized lumps of mineral are exposed to the same distribution influences of the drum assemblies 20 (i.e. alternate widthwise movement relative to the breaker as they are moved towards the second end 22) but in addition they are exposed to a breaking action by being gripped in-between opposed teeth on neighbouring drum assemblies. This is illustrated in FIG. 4 wherein a lump LP1 is shown being gripped within a region 35 in-between opposed teeth 31 on neighbouring drum assemblies 20. In this region 35, the breaking action is as a result of the front 31*a* of a tooth 31 on the right hand drum assembly 20 breaking down onto the backs 31*b* of a pair of teeth 31 on the left hand drum assembly and also as a result of the fronts 31*a* of opposed teeth 31 on the left hand and right hand drum assemblies 20.

In order to achieve a positive "bite" on a lump LP1 in region 35 the teeth 31 are each preferably of an elongate shape having a relatively short leading face 31*f* and a relatively long trailing face 31*t* such that each tooth not only projects radially of the shaft 25 but also has a positive rake (i.e. the longitudinal axis $L_A$ of the tooth is inclined into the direction of rotation of the shaft 25) preferably to the extent that as seen in FIG. 4, the longitudinal axis $L_A$ of each tooth extends in a direction which is generally tangential to the shaft 25.

Preferably the leading face 31*f* extends (relative to the direction of rotation) rearwardly away from the tip 131 to thereby provide clearance behind the tip 131 during the breaking action. Preferably, in this respect, the leading face 31*f* defines a recess or pocket 132 behind the tooth tip 131. This arrangement assists in providing a positive "bite" in region 35 for gripping and thereby breaking oversized lumps LP1 located in region 35.

As the teeth 31 on the right hand side of a drum assembly rises, it will lift remaining oversized lumps away from the preceding drum assembly 20 and then move it toward the next succeeding drum assembly 20.

Accordingly, as the infill is moved by drum assemblies towards the second end 22, not only is the undersized material encouraged to pass between the drum assemblies 20 by downward movement of the teeth on the left hand side of the rotating drum 20, but also oversized lumps are progressively attacked to be broken as they are moved towards the second end.

As indicated above, the drum assembly 20 located adjacent to the second end 22 is rotated in the opposite direction and so the last two drum. assemblies 20 act to break down the oversized lumps in a manner similar to that described in our EP 0167178.

It will be seen that the drums in group FD have the teeth 31 arranged such that the teeth on the upper side of each drum are generally tangentially directed towards the second end whereas the teeth on drum 120 are directed towards the first end 21. This provides an effective bite or grip region BR which is greater than that between the preceding drum assemblies 20.

It will be noted that the channels 40 on drum assemblies 120, 220 are of opposite hand sense. Since these drum assemblies rotate in opposite directions it means that material located on top of these drums are moved axially in the same direction towards one side of the breaker 10. This is a useful facility as it provides the function of oversize material which has not been broken being rejected at location RM (FIG. 1).

Figure 3:
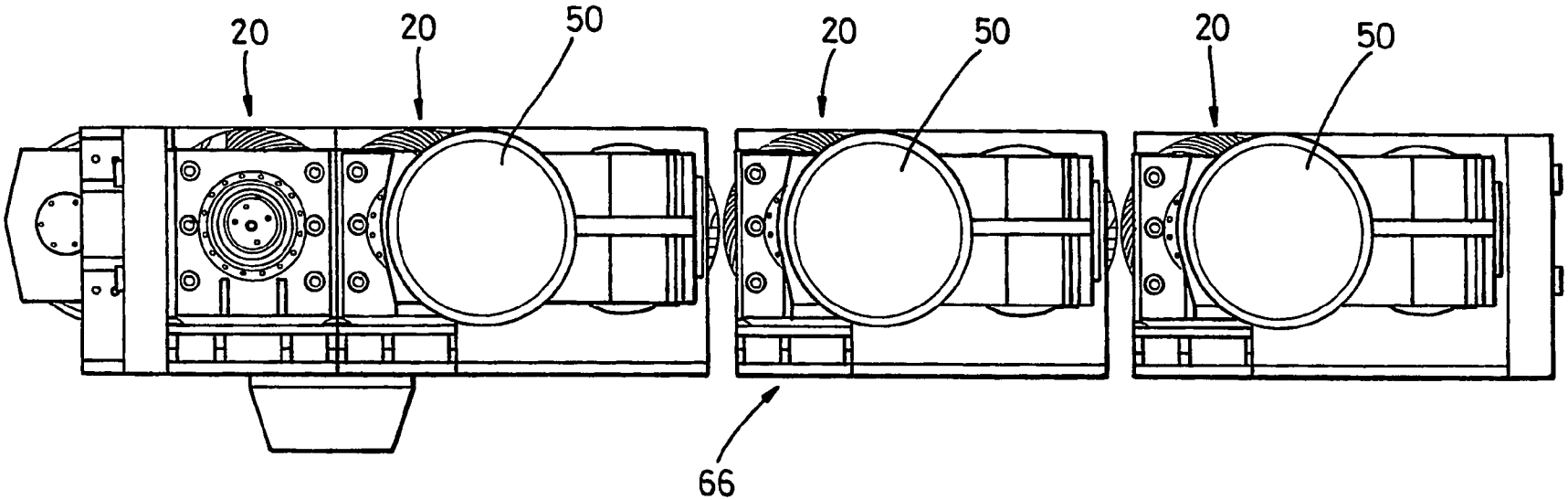
FIG. 3 is a side view of the breaker shown in FIG. 1.

Preferably as shown in FIGS. 1 to 3, each drum assembly 20 and associated motor 50 are constructed to form part of an independent breaker drum module 60 including a pair of opposed end wall assemblies 66 in which the shaft 25 is rotatably housed.

The breaker 10 is therefore constructed from a series of identical modules 60 extending between the first and second ends 21,22. The end wall assemblies 66 are conveniently mounted on beams 67 running either side of a conveyor 80 located beneath the breaker 10.

It will be appreciated therefore that the capacity of the breaker 10 can be easy increased or decreased on site by the addition or removal of modules 60. This enables the capacity of the breaker to be conveniently and cost effectively tailored to specific applications.

In addition, it will be appreciated that the spacing between modules may be easily adjusted in order to vary the spacing between adjacent drum assemblies 20 and so provide adjustment for the amount and size of undersize able to pass between the drum assemblies and to also adjust the grip region 35.

It will also be appreciated that different numbers, sizes and shapes of teeth 31 may be provided on adjacent drum assemblies 20 in order to vary the performance of the breaker 10 as material is moved from end 21 towards end 22.

Preferably as shown, a breaker bar assembly 100 is located beneath drum assemblies 120, 220 to co-operate therewith to cause further breaking of the mineral. The breaker bar assembly is conveniently of a construction as described in either of our pending UK patent applications 0308933.1 and 0326157.5.

Preferably, cleaning blades 90 are located inbetween each disc 30 in order to clear the space inbetween adjacent discs 30 of sticky material such as tar sand or clay.

It is envisaged that the mineral breaker of the present invention can be modified for use in the preparation of slurries, such as for the preparation of oil sand slurries.

An embodiment of a slurry preparation apparatus incorporating a mineral breaker of the present invention is illustrated in FIGS. 5 to 8.

The apparatus 200 includes a mineral breaker as described above with reference to FIGS. 1 to 4. A hood 210 is mounted above the mineral breaker to define a fluid tight inlet chamber 220 for introducing infill material to be processed and fluid toward the first end 21 of the mineral breaker 10.

The hood 210 includes a material inlet 215 through which material to be processed is introduced into the chamber 220 and onto the breaker 10.

Preferably the hood 210 is of a one piece construction which is mounted on top of the breaker 10 and secured thereto by bolts. This arrangement enables the hood 210 to be totally removed in a convenient manner, say by a hoist (not shown) to a remote location (as shown in broken lines) to enable maintenance operations to be performed on the breaker 10.

Located beneath the breaker 10 is a sump 230 which is arranged to receive slurry mixture and broken down material falling from the mineral breaker 10.

A slurry outlet 240 is located within the sump 230; the slurry outlet 240 is connected to a pipeline 242 along which the slurry in the sump 230 is pumped away by a centrifugal pump 244.

The sump 230 is preferably formed from a housing 231 which is sealingly mounted beneath the breaker 10 such that the hood 210, breaker and sump 230 define a fluid tight passageway extending between the material inlet 215 and the slurry outlet 240.

In other words, the breaker extends across the passageway extending between the material inlet 215 and the slurry outlet 240 such that all material travelling into the sump 230 from the chamber 220 has to pass through the breaker 10, i.e. the breaker 10 acts to permit only material below a predetermined lump size to pass into sump 230.

In order to create a slurry, at least one fluid discharge outlet 250 is positioned within the chamber 220 to direct a flow of fluid, usually water, down onto the breaker 10.

Preferably a main fluid discharge outlet 250 is provided adjacent to the material inlet 215 to direct a stream of water down into the material being fed through the material inlet 215. Preferably the stream of water being discharged from the main outlet 250 is in the form of a curtain of water CW which extends across the feed direction of the infill material.

Preferably the main outlet 250 is in the form of an open topped trough 255 having a side wall 256 defining a weir over which water is able to cascade to define the water curtain. Preferably water is fed into and along the trough at a high volume of flow in order to create a continuous curtain along the length of the trough and a curtain of a desired thickness. The water fed into trough 255 is taken from an outside source and, as indicated below, may be supplemented with slurry taken from the sump 230.

It is envisaged that the material to be processed will normally be introduced through the material inlet 215 by being thrown from a high speed conveyor HC. Preferably the main outlet 250 is positioned such that the curtain of water being produced thereby is across the entire width of the conveyor HC and is directed towards the breaker 10 so as to intersect the flight F of material being thrown from the conveyor HC at the material inlet 215. This is advantageous as it encourages the flight of the thrown material to be blocked and encourage the material to be deposited onto the breaker closer to the inlet end 21 of the breaker than if the curtain of water were not present. In addition, impingement of the curtain of water with the material whilst it is in flight encourages breakdown of lumps of material by the water and also aids mixing of the water and material before being deposited onto the breaker 10. Preferably, if required a physical curtain, such as a chain curtain CC may be suspended from the trough 255 in order to assist in deflecting the material being thrown from conveyor HC down towards the first end 21 of the breaker 10.

It is expected that the water/material mix being deposited onto the breaker 10 will be, on the one hand, a slurry comprising undersize material and water and on the other hand, oversized material.

The slurry will fall through the breaker into the sump 230 and oversized material will be acted upon by the feeder breaker drums 20.

Accordingly, rotation of the feeder breaker drums 20 will act to encourage movement of the slurry toward the sump 250 whilst at the same time encouraging mixing of the slurry. In addition, the oversized lumps of material are moved away from the first end 21 of the breaker 10 toward its second end 22. In doing so, the oversized material is acted upon to be broken down and mixed into a slurry.

It is envisaged that with the above arrangement, the final contra-rotating breaker drum located adjacent to the second end 22 may be dispensed with and replaced by a feeder drum assembly and the breaker 10 be provided with an oversized discharge outlet at its second end. With such an arrangement, it is assumed that any oversized material reaching the second end 22 of the breaker 10 is 'waste' material. With such an arrangement, the breaker 10 not only acts to prepare a slurry from material being introduced through the material inlet 215, it is also acting to separate oversized waste material out of material being introduced through inlet 215.

With the above apparatus, it is envisaged that a compact slurry preparation apparatus handling high throughputs may be achieved. For example, it is envisaged that a breaker 10 having say 4 meter long breaker drums could handle a throughput of 10,000 tons/hour of tar sand.

It is envisaged that a portion of the slurry in the sump may be recycled for feeding back through the breaker 10. The recirculation circuit preferably includes a recirculating pump (not shown) which is preferably a high powered centrifugal pump and a conduit RC which draws slurry from the sump 230 and feeds it to the trough 255 for discharge therefrom. The centrifugal pump provides the added benefit of further breaking down lumps of material in the slurry during recirculation to improve the overall consistency of the slurry in the sump 230.

Additional water discharge outlets may be provided either above, or preferably below the breaker 10, for introducing additional water into the apparatus for achieving a desired specific gravity of the slurry in the sump 230.

Figure 8:
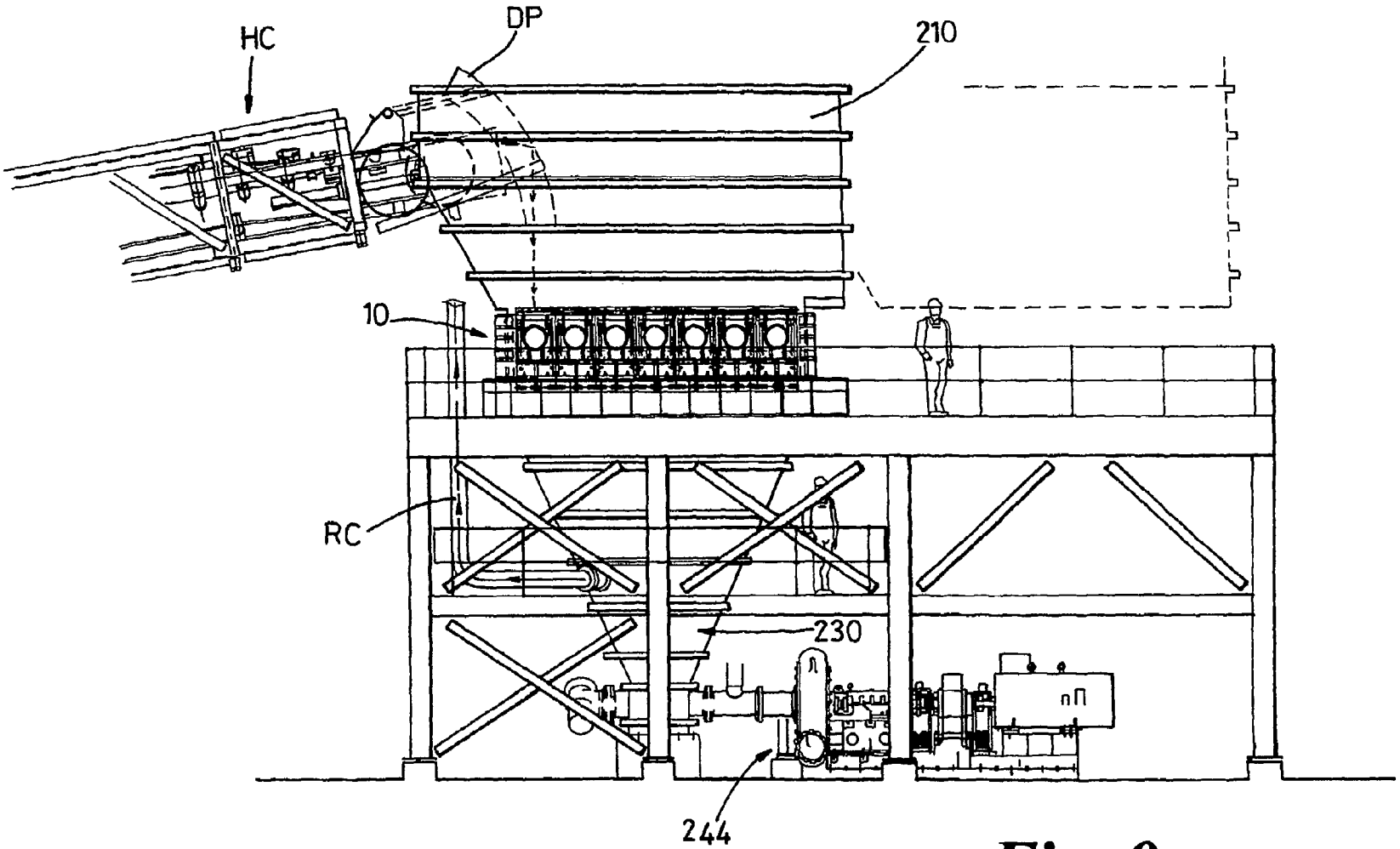
FIG. 8 is a side view of apparatus similar to that shown in FIG. 5 incorporating an adjustable deflector plate.

As indicated in FIG. 8, the flight of material being discharged from conveyor HC may be deflected using an adjustable deflector plate DP. The deflector plate DP may be used in dry applications to ensure the discharged material is directed to the first end 21 of the breaker 10. It may also be used in wet applications for the preparation of slurries. In such arrangements, water would be directed toward the material as it falls from the deflector plate DP.

What is claimed is:

1. A mineral breaker having a first end and a second opposed end and a plurality of breaker drums arranged side by side in a row extending between said ends, the drums being arranged with their axes of rotation parallel to one another. at least two neighbouring drums adjacent to the first end being arranged to continuously rotate in the same direction to define feeder drums for feeding material toward the second end, each breaker drum having radially projecting breaker teeth which co-operate with opposed breaker teeth on the adjacent drum to grip oversized mineral material, which may include relatively hard, dense chunks, therebetween to cause breakage, to permit passage of undersized material therebetween, and to move unbroken oversized material toward said second end, wherein the teeth on each drum are of a size and shape to define discrete deep channels extending helically along the drum.

2. A mineral breaker according to claim 1 wherein at least a further one of said drums in said row, adjacent to the endmost feeder drum which is furthermost from the first end, is arranged to continuously rotate in the opposite direction.

3. A mineral breaker according to claim 2 wherein for each channel, the ratio of depth of channel relative to the radial height of the tooth tip from the axis of rotation of the drum is in the range of 1:3 to 1:2.

4. A mineral breaker according to claim 3 wherein, the helical channels on one feeder drum extend in a right or left handed sense along the drum and wherein the helical channels on the adjacent feeder drum extend therealong in the opposite handed sense to thereby cause material to be alternately moved widthwise of the breaker as it is moved towards said second end.

5. A mineral breaker according to claim 2 wherein, the helical channels on one feeder drum extend in a right or left handed sense along the drum and wherein the helical channels on the adjacent feeder drum extend therealong in the opposite handed sense to thereby cause material to be alternately moved widthwise of the breaker as it is moved towards said second end.

6. A mineral breaker according to claim 1. wherein for each channel, the, ratio of depth of channel relative to the radial height of the tooth tip from the axis of rotation of the drum is in the range of 1:3 to 1:2.

7. A mineral breaker according to claim 6 wherein, the helical channels on one feeder drum extend in a right or left handed sense along the drum and wherein the helical channels on the adjacent feeder drum extend therealong in the opposite handed sense to thereby cause material to be alternately moved widthwise of the breaker as it is moved towards said second end.

8. A mineral breaker according to claim 1 wherein, the helical channels on one feeder drum extend in a right or left handed sense along the drum and wherein the helical channels on the adjacent feeder drum extend therealong in the opposite handed sense to thereby cause material to be alternately moved widthwise of the breaker as it is moved towards said second end.

9. A mineral breaker according to claim 1 wherein, each drum includes a shaft having mounted thereon a plurality of toothed rings spaced along the shaft, each ring having a plurality of breaker teeth spaced about the circumference of the ring, the rings on one drum being axially offset to the rings on the adjacent drum such that a ring on one drum is located axially in-between a pair of adjacent rings on the adjacent drum.

10. A mineral breaker according to claim 9 wherein each tooth on each ring is generally elongate and has a longitudinal axis which is generally tangential to the axis of rotation.

11. A mineral breaker according to claim 9 wherein each drum and associated motor form part of a breaker drum module, the breaker being assembled from a plurality of said modules.

12. A mineral breaker according to claim 9 having a means for adding a fluid to the breaker to create a slurry.

13. A mineral breaker according to claim 12 wherein the apparatus includes a passageway having a material inlet and fluid inlet at one end of the passageway and a slurry discharge at the other end of the passageway, the breaker being located to close off the passageway such that only material under a predetermined size and fluid is able to pass along the passageway to said slurry discharge.

14. A mineral breaker according to claim 9 wherein, an associated motor independently drives each drum.

15. A mineral breaker according to claim 1 wherein, an associated motor independently drives each drum.

16. A mineral breaker according to claim 1 wherein each drum and associated motor form part of a breaker drum module, the breaker being assembled from a plurality of said modules.

17. A mineral breaker according to claim 1 having a means for adding a fluid to the breaker to create a slurry.

18. A mineral breaker according to claim 17 wherein the apparatus includes a passageway having a material inlet and fluid inlet at one end of the passageway and a slurry discharge at the other end of the passageway, the breaker being located to close off the passageway such that only material under a predetermined size and fluid is able to pass along the passageway to said slurry discharge.

* * * * *